United States Patent [19]

Brockmanns et al.

[11] Patent Number: 4,676,062

[45] Date of Patent: Jun. 30, 1987

[54] METHOD AND DEVICE FOR THE FORMATION OF SPINNING FIBERS

[76] Inventors: Karl-Josef Brockmanns, Jakob-Krebs-Strasse 80, D-4156 Willich 2 - Anrath; Joachim Lünenschloss, Schloss-Schönau-Strasse 81, D-5100 Aachen, both of Fed. Rep. of Germany

[21] Appl. No.: 693,390

[22] Filed: Jan. 18, 1985

[30] Foreign Application Priority Data

Jan. 21, 1984 [DE] Fed. Rep. of Germany ..... 3402083

[51] Int. Cl.[4] ..... D01H 7/895; D01H 7/882

[52] U.S. Cl. ..... 57/400; 57/328; 57/401; 57/403; 57/408

[58] Field of Search ..... 57/328, 315, 333, 400, 57/401, 403, 5, 408

[56] References Cited

U.S. PATENT DOCUMENTS 3,844,097 10/1974 Bobkowicz et al. ..... 57/5
3,848,403 11/1974 Bobkowicz et al. ..... 57/403 X
3,924,396 12/1975 Bobkowicz et al. ..... 57/5
3,987,612 10/1976 Bobkowicz ..... 57/5
4,209,965 7/1980 Bobkowicz ..... 57/5
4,222,222 9/1980 Didek et al. ..... 57/401

*Primary Examiner*—Stuart S. Levy
*Assistant Examiner*—Joseph J. Hail, III
*Attorney, Agent, or Firm*—Herbert L. Lerner; Laurence A. Greenberg

[57] ABSTRACT

Method of forming spinning fibers for producing a thread, which includes applying at least one laterally limited swarm of spinning fibers continuously to an outer cylindrical surface of a rotating, perforated drum having an interior, to which suction air is applied, further transporting the spinning fibers on the drum in peripheral direction of the drum along a spatial, spiral path wherein the spinning fibers are, respectively, accelerated, decelerated and individually separated from one another, clamping the spinning fibers at an outer end of the spiral path at a clamping line between the drum and at least one clamping element engaging the drum, and continuously conducting the spinning fibers away from the clamping line to at least one thread forming device.

13 Claims, 11 Drawing Figures

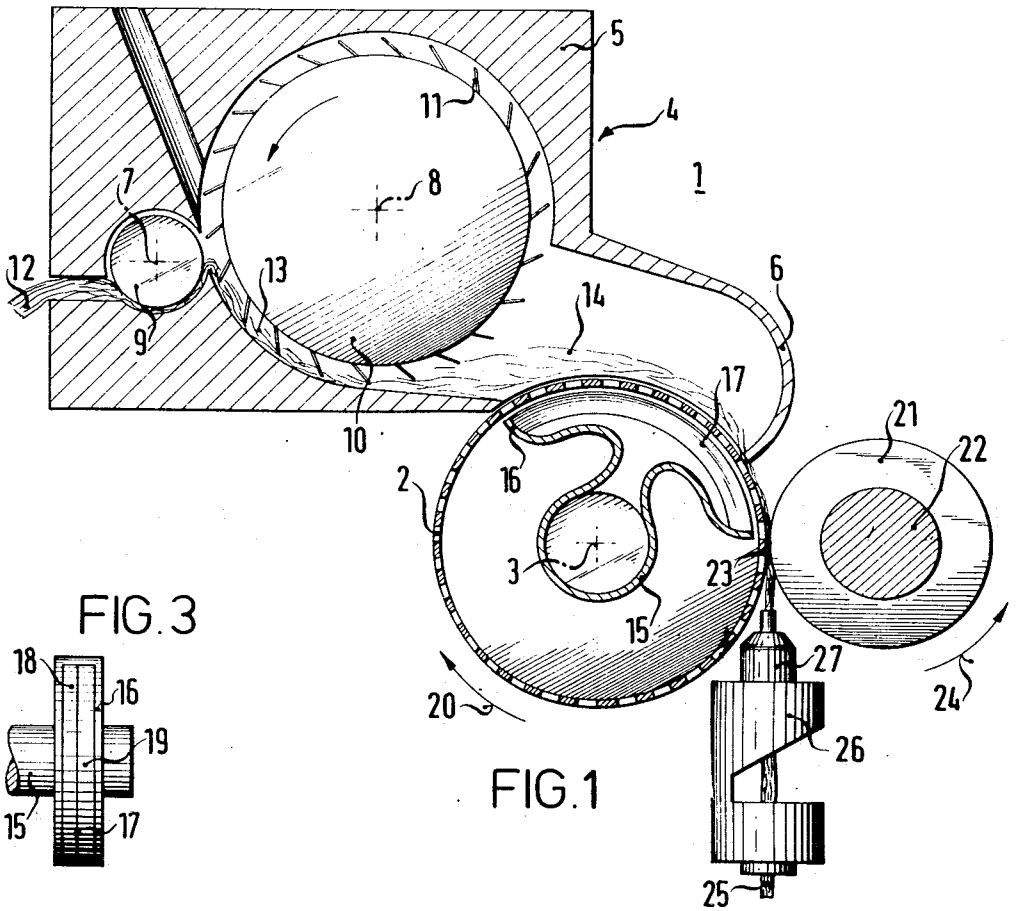
FIG. 1
FIG. 3
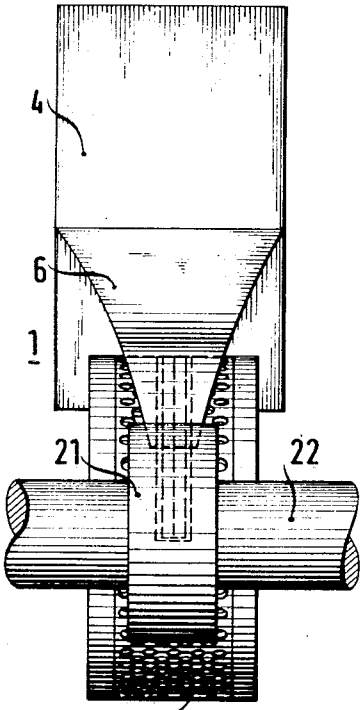
FIG. 2

METHOD AND DEVICE FOR THE FORMATION OF SPINNING FIBERS

The invention relates to a method and a device for the formation of spinning fibers for producing a thread.

The forming of a thread from spinning fibers has quality and productivity limitations, where the adjusting of the fiber supply with respect to thread withdrawal and thread twist are difficult.

For this reason all spinning methods known up to this time could use some improvement, and from time to time new spinning methods and new spinning devices come up, which sometimes replace the old methods and devices.

The invention has the basic objective to improve the formation of the spinning fibers before the actual spinning operation, this means before the actual generating of the thread, so that also the result of the spinning is improved with respect to quality, fineness of the thread, and also with respect to production rate.

This objective is achieved by the inventive method and device as claimed.

The advantages achieved with the method consist especially in that the production of a uniform thread, and if desired also a thread of great fineness is made possible with great production rates.

The invention and its advantages will be still further explained and described with the aid of the specific embodiments which are used as examples, and illustrated in the drawings.

FIG. 1 shows schematically a cross section through a first device, according to the invention.

FIG. 2 shows a front view of the device according to FIG. 1.

FIG. 3 shows a view of the suction arrangement of the device according to FIG. 1 and 2.

Figure 4:
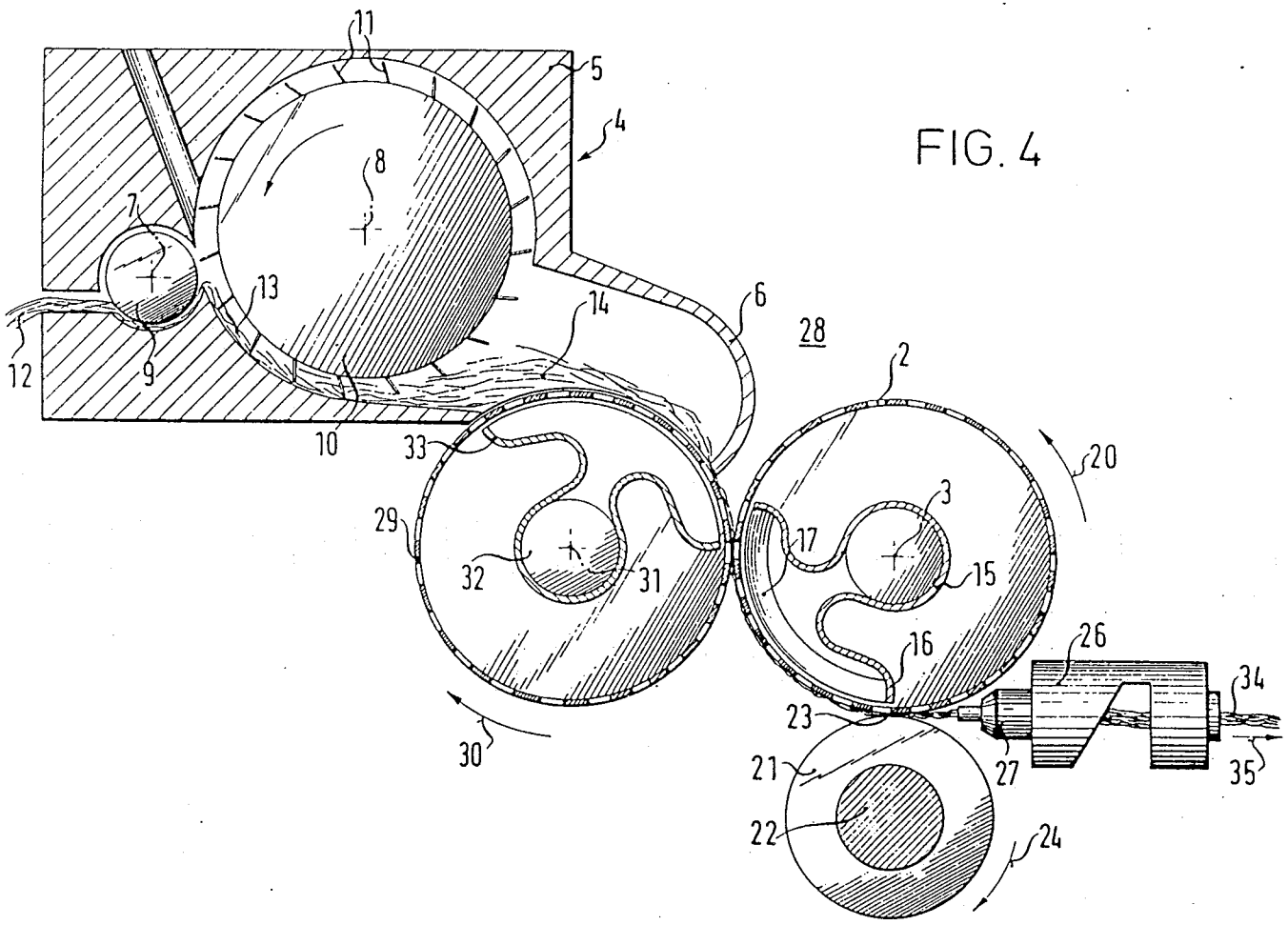
FIG. 4 shows schematically a cross-section through a second device according to the invention.

At the device 1 for the formation of spinning fibers shown in FIGS. 1 and 2, a perforated drum 2, whose interior is acted upon by suction air, is rotatably supported around the rotation axis 3. Details of the bearing support and of the drive are not shown here.

Ahead of drum 2 a fiber loosening device 4 is arranged which comprises a housing 5 and a fiber canal 6. In a first hollow cut-out of the housing 5 a feed roller 9 rotates around rotation axis 7. In an additional hollow cut-out of the housing 5, immediately adjacently to feed roller 9, a loosening roller 10 rotates around the rotation axis 8, whereby the loosening roller 10 is provided with a set of needles 11.

A fiber sliver 12 is conducted by the slowly rotating feed-roller 9 to the needle set 11 of the loosening roller 10 which rotates with the high circumferential velocity, whereby individual spinning fibers 13 are loosened from the fiber sliver 12, so that in the fiber canal 6 a swarm of spinning fibers 14 is formed which is carried and transported by the air current.

The drum 2 is acted upon by suction air in the following manner: A tubular suction device 15 is provided with a suction slit 16, which is directed toward the mantle of the drum 2, and terminates a slight distance which prevents sliding contact away from the mantle of drum 2. Form and configuration of the suction slit 16 can be learned from FIG. 1 and 3. The suction slit 16 is subdivided longitudinally by a lip 17 in two suction-compartments 18 and 19. According to FIG. 1, the drum 2 rotates in the direction of the curved arrow 20. Upstream from the fiber canal 6 a clamping device 21 lies on the drum 2. The clamping dvice 21 is constructed in the form of a roller which preferably is provided with a rubber mantle, and is rotatably supported on an axis 22.

Because the swarm of spinning fibers 14 under the action of the suction air forms itself above the suction slit 16, and applies itself onto the mantle surface of the drum 2, the drum 2 together with the clamping device 21 forms a clamping line 23 for the spinning fiber swarm 14 whose position is already fixed on the drum 2. Since the suction air flows also through the fiber canal 6, the individual fibers of the fiber swarm 14 in the fiber canal 6 are carried and transported by the suction air current flowing through the drum 2, respectively through its suction slit 6.

FIG. 1 shows that the roller-shaped clamping device 21 rotates in the direction of the curved arrow 24. As a rule no special drive is required, the roller 21 is carried along by friction. According to FIG. 1 a thread forming element 26 is arranged upstream from the clamping line 23, which transforms the swarm of spinning fibers to a thread 25. The thread forming element 26 is here a thread-twist generator which is provided with a by itself known, with compressed air operated air-twist nozzle 27 through which the thread 25 is conducted.

While the thread 25 runs with great velocity through the air twist-nozzle 27, a cyclone flow generated by the supplied compressed air applies a false twist to the incoming fiber-swarm, respectively thread 25, whereby the outer fibers surround and strengthen the thread after leaving the thread twist generator 26.

In principle also a number of other known thread forming devices can be used as the thread formly element, for instance, a mechanical twist generator. The cohesion of the fibers, and the strength of the thread can also be obtained by heating, cementing, by alternate twisting, or other methods used in a thread-forming device.

The narrow form of the suction slit 16, and its subdivision by a lip 17 have the purpose to deposit the individual fibers in a stretched state onto the mantle of the perforated drum 2. A well streched position of the fibers contributes to a good spinning result. At the second embodiment used as an example of the invention, according to FIG. 4, at the here shown device 28 for the formation of spinning fibers the parts and assemblies already known from the first embodiment according to FIGS. 1 to 3 are used. These parts are designated with the same reference nubmers as used at the first typical embodiment, so that at this point the used parts will not be explained again.

At the embodiment according to FIG. 4 a first, perforated with suction air supplied drum 29 is arranged ahead of perforated drum 2, in such a manner that it tangentially contacts the swarm of spinning fibers 14, sucks it up, and holds and transport it in the circumferential direction to the second drum 2. Both drums rotate in opposite directions, the first drum 29 in the direction of the curved arrow 30. The circumferential velocity of the first drum 29 is lesser than the surface velocity of the second drum 2. The rotation axis of the first drum 29 is designated with 31.

Also the first drum 29 here is provided with a tubular suction device designated with 32, which has a suction slit 33 which is directed from the interior toward the mantle of the drum. The suction slit 33 is constructed exactly like the suction slit 16 of the drum 2, with the difference that the lip 17 is omitted, so that the suction slit is not divided.

At this embodiment the swarm of spinning fibers 14 first reaches drum 29, and is then conducted to the adjacent drum 2, at the transfer point due to the difference of the surface speeds the fibers swarm is accelerated, stretched and pulled out, and then transported further on drum 2 to the clamping line 23. From the clamping line 23 the already bundled, flattened, well formed, stretched and pulled-out fiber-swarm gets into the air twist-nozzle 27 of the thread forming element 26, which then forms the thread 34 at a high production rate.

At an alternate version of the second embodiment used as example, it may be provided that the surface speed of the first perforated drum 29 is greater than the surface speed of the speed perforated drum 2, so that at the transfer point deceleration effects take place, and a somewhat more voluminous thread is obtained.

At the first as well as at the second embodiment the thread is withdrawn from the thread forming element 26 in the direction of arrow 35. One of the known thread withdrawal devices can be used for the withdrawal, which usually consist of a pair of rollers.

Figure 5:
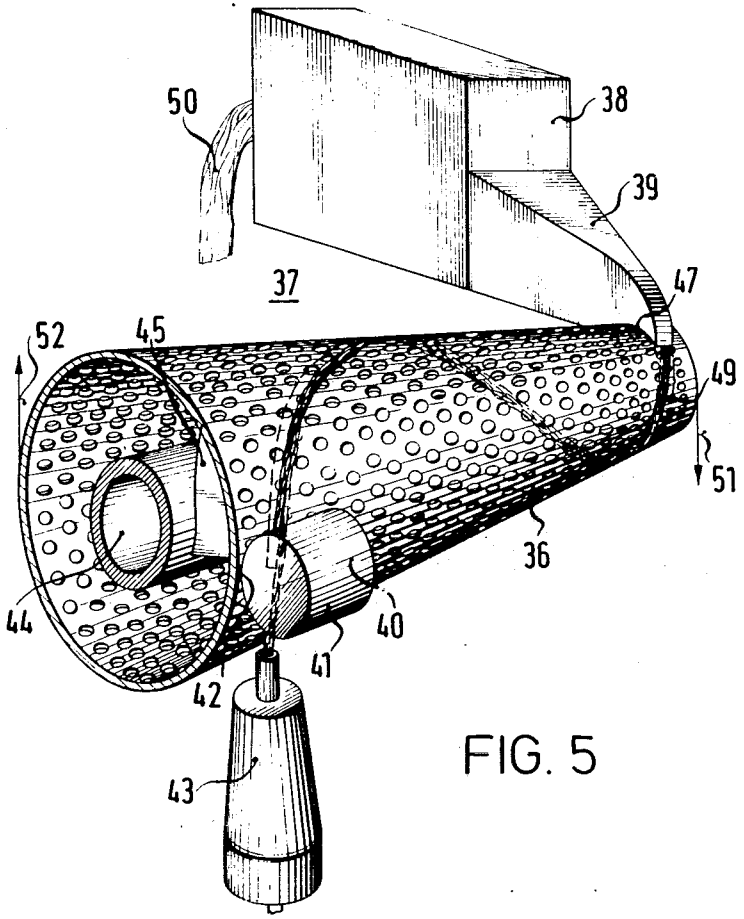
FIG. 5 shows a simplified representation of a perspective view of a third device according to the invention.

While the perforated drums of the two first embodiments used as examples had cylindrical mantle surfaces, a conically shaped mantle is used for the perforated drum 36 of the third specific embodiment according to FIG. 5. At this example the device for the formation of the spinning fibers is as a whole designated with 37, and comprises beside the perforated drum 36 a fiber loosening device 38 with a fiber canal 39, a clamping device 41 which can rotate around the rotation axis 40, and a thread forming element 43 which is arranged downstream from the clamping line 42. In the interior of the perforated drum 36 is a tubular suction device 44 with a suction slit 45 which is arranged along a spatial spiral line.

Figure 6:
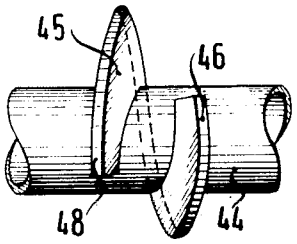
FIG. 6 shows a view of a suction arrangement for the device according to FIG. 5.

FIG. 6 shows the configuration of the suction slit 45 in a condensed form. The suction slit 45 is arranged so that opposite to the inner end 46 of the spatial spiral the fiber discharge point 47 of the fiber canal 39 is disposed, and opposite of the outer end 48 of the spatial spiral the clamping region fo the fiber-swarm 49 is located in the form of clamping line 42.

A fiber sliver 50 is conducted to the fiber loosening device 38, is there dissolved in individual fibers, which as a swarm of spinning fibers flow through the fiber canal 39, then bundled to form a small band lying on the drum surface of drum 36, follow the spiral line of the suction slit 45 due to the rotation of the drum in direction of arrows 51, 52, and finally reach the clamping line 42, and are continuously pulled off, whereby in the thread forming element 43 the spinning fiber swarm is transformed to a thread.

While the swarm of spinning fibers moves through the spiralline it is automatically continuously accelerated, thereby stretched further, made finer and becomes more flattened.

Figure 7:
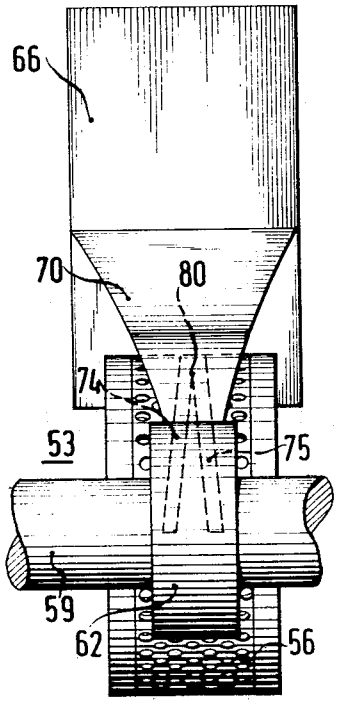

At the fourth embodiment used as an example, according to FIG. 7, the device for the formation of spinning fibers is as a whole designated with 53, and is provided with a cylindrical, perforated drum 56, whose interior is acted upon by suction air, and has a roller-shaped clamping device 62, which can rotate around an axis 59, and a fiber loosening device 66 with a fiber canal 70.

The special feature of this device 53 lies in the fact that the suction arrangement which is not further illustrated has two suction slits 74 and 75 which are united with each other below the fiber contact region 80 of the drum 56, but diverge again from there on. By this arrangement of the suction slots, two separate fiber-swarms are formed from the single fiber-swarm, which are either used to generate two separate threads, or can be utilized to produce two intertwined threads.

The fifth embodiment used as an example shows a device for the formation of spinning fibers which are a whole is designated with 54. Here are two clamping devices 63 and 64, which are rotatable on a common axis 60 mounted to the perforated drum 57. Each of these clamping devices is supplied with a swarm of spinning fibers, and for this purpose two fiber loosening devices are provided arranged side by side, whose fiber canals 71 and 72 terminate above the suction slits 76 and 77 which are separated from each other.

Figure 9:
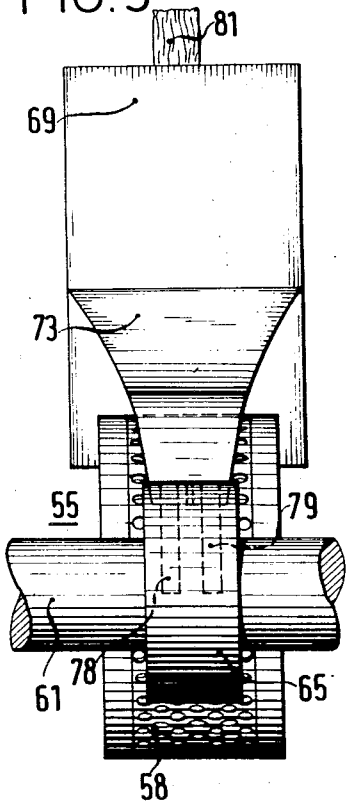
FIGS. 7, 8 and 9 show front views of additional devices according to the invention in simplified representations.
Figure 8:
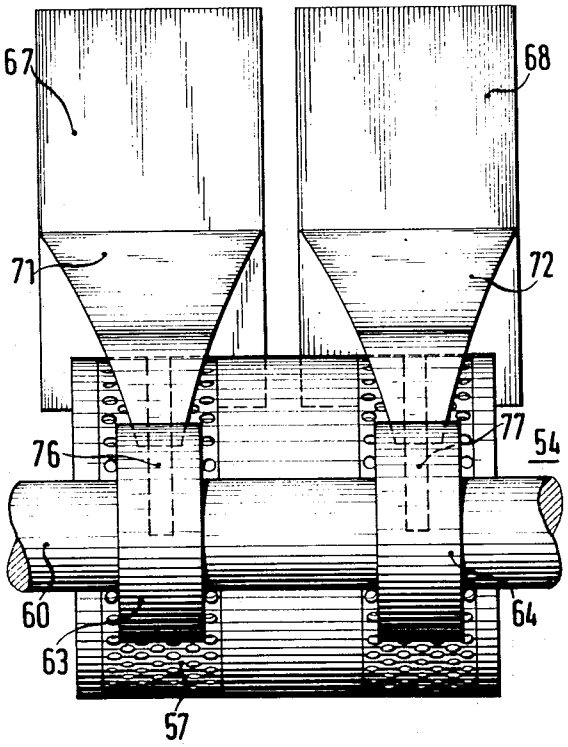

At the sixth embodiment used as an example, according to FIG. 9, the device for the formation of spinning fibers is as a whole designated with 55. A clamping device 65 is supported on its drum 58, which can rotate on the axis 61. The fiber loosening device 69 has provisions for forming from each other separated swarms of spinning fibers from a common fiber sliver feeding device 81. A specific example of these provisions will be explained later. Each spinning fiber swarm is sucked up by the use of a special suction slit 78, respectively 79, held, and transported along in the transport direction of the drum 58. Here the two suction slits 78, 79 are arranged closely adjacent and parallelly side by side.

Figure 10:
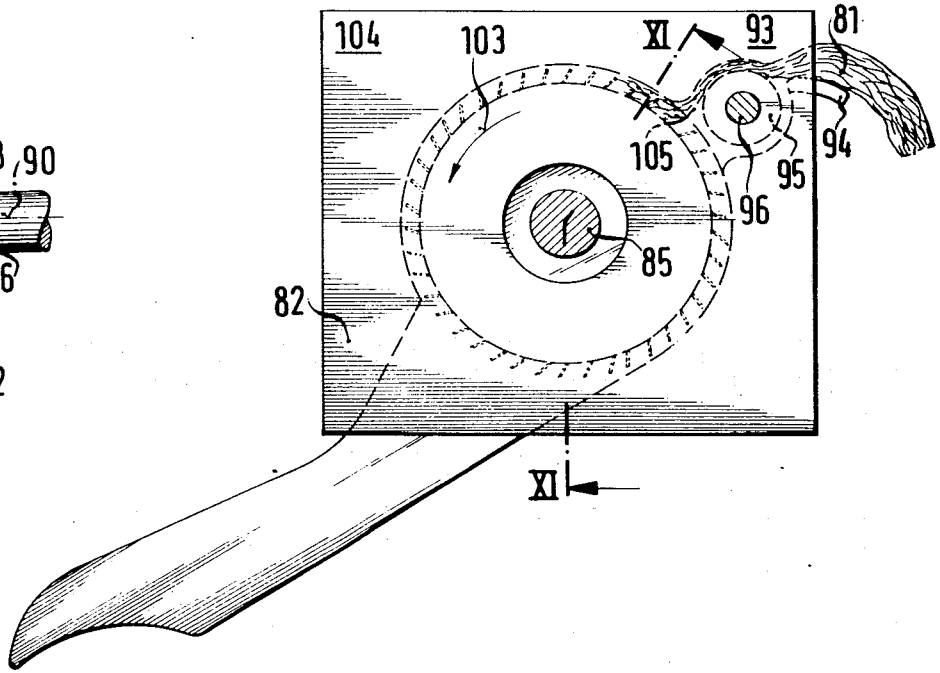
FIG. 10 shows a side view of a device for loosening the fibers suitable for the device according to FIG. 9.
Figure 11:
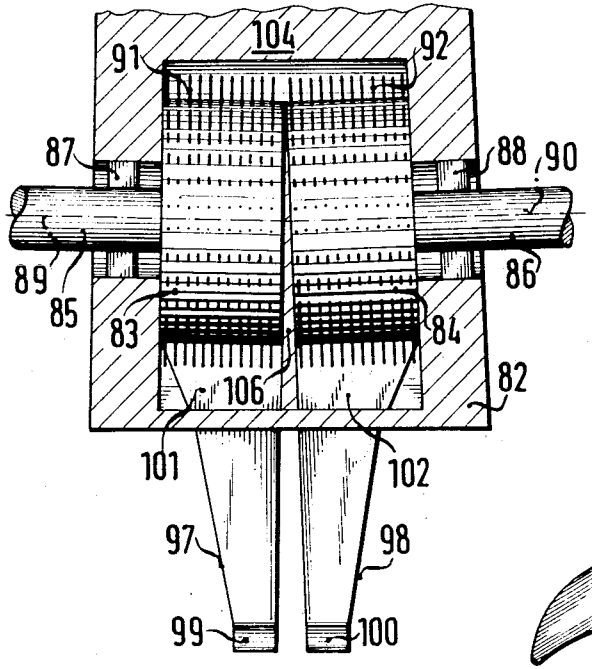
FIG. 11 shows a section through the fiber loosening device along line XI—XI shown in FIG. 10.

A typical embodiment of a fiber loosening device 104, with provisions for generating from a common fiber-silver feeding device two from each other separated spinning fiber swarms, is illustrated in FIGS. 10 and 11.

The housing 82 of the fiber loosening device 104 contains two loosening rollers 83 and 84. The loosening roller 83 is fastened to a shaft 85, the loosening roller 84 to a shaft 86. Roller bearings 87, respectively 88, support the shafts 85, respectively 86 in the housing 82. The rotation axis 89 of the loosening roller 83 is inclined about three degrees to the rotation axis 90 of the loosening roller 84. Each of the shafts 85, 86 is driven separately. The required drivers for this purpose are not shown in the drawing. The loosening roller 83 is provided with a set of needles 91 distributed over its circumference, the loosening roller 84 is equipped with a similar set 92.

The fiber loosening device 104 comprises a fiber-sliver feeding device which as a whole is designated with 93. The fiber-sliver feeding device 93 is provided with an infeed table 94 and a rotating input roller 95, whose driveshaft extends from the housing 82.

Two fiber transfer devices 97 and 98 are provided which are separated from each other. Both fiber transfer devices are constructed in the form of fiber canals, whose terminations 99, respectively 100, in practical operation lie at regions of negative pressure, so that an air current exists in the fiber transfer devices which carries, and transports the spinning fiber swarms.

FIG. 11 shows that the two loosening rollers 83, 84 diverge from each other, according to FIG. 10 in the direction of the fiber-transport, which occurs in the direction of the curved arrow 103. The arrow 103 also indicates the rotational direction of the two loosening rollers 83, 84. The two loosening rollers 83, 84 diverge from each other in such a way that they are closely adjacent to each other at the fiber-sliver feeding region 105 and spaced a distance away from each other at the fiber-discharge points, i.e. the entrances 101, 102 of the fiber transfer devices 97, 98.

In FIG. 11 it is also indicated that a separating wall 106 is arranged between the loosening rollers 84, 84, which helps to separate the spinning fiber swarms.

The invention should not be limited to the illustrated, and described embodiments which were used as examples.

We claim:

1. Method of forming spinning fibers for producing a thread, which comprises applying at least one laterally limited swarm of spinning fibers continuously to a relatively narrow-diameter portion of an outer conical surface of a rotating, perforated conical drum having an interior, to which suction air is applied, further transporting the spinning fibers on the drum in peripheral direction of the drum along a spatial, spiral path wherein the spinning fibers are, respectively accelerated, decelerated and individually separated from one another, clamping the spinning fibers at an outer end of the spiral path at a clamping line between the drum and at least one clamping element engaging the drum at a relatively wide-diameter portion of the outer conical surface of the perforated conical drum, and continuously conducting the spinning fibers away from the clamping line to at least one thread forming device.

2. Method according to claim 1, wherein includes, before applying the swarm of spinning fibers to the drum, loosening the spinning fibers by means of a loosening device from a sliver and conducting the spinning fibers in a fiber-carrying air current through a fiber channel terminating at the drum.

3. Method according to claim 1, wherein the suction air is applied from the interior of the perforated drum only at at least one limited suction zone located at or before the clamping line.

4. Device for forming spinning fibers for producing a thread, comprising a conical perforated drum having an interior to which suction air is applied, said drum being rotatably mounted so as to tangentially hold by suction and transport in a travel path in peripheral direction of the drum a swarm of spinning fibers, means adjacent to a relatively narrow-diameter portion of said perforated conical drum for feeding the swarm of spinning fibers thereto, at least one clamping device mounted adjacent to a relatively wide-diameter portion of said drum so as to act clampingly on the spinning fibers held by suction, said clamping device forming a clamping line with an outer conical surface of said drum, and at least one thread-forming device disposed at a location of said travel path other than upstream of said clamping line for receiving the spinning fibers and forming at least one thread therefrom.

5. Device according to claim 4 wherein said thread forming device includes a thread twister.

6. Device according to claim 5 wherein said thread twister has an air twisting nozzle through which the formed thread travels, said air twisting nozzle being acted upon by pressurized air.

7. Device according to claim 4, including at least one fiber loosening device located upstream of said perforated drum.

8. Device according to claim 7, wherein said fiber loosening device has a rotatable loosening roller formed with a set of needles or serrations.

9. Device according to claim 4, including a suction device located in said interior of said drum and having at least one suction slit directed outwardly from said interior to said outer conical surface of said drum.

10. Device according to claim 9 wherein said suction slit terminates at a location spaced slightly from an outer casing of said drum so as to avoid dragging contact therewith.

11. Device for forming spinning fibers for producing a thread, comprising a perforated drum having an interior to which suction air is applied, said drum being rotatably mounted so as to tangentially hold by suction and transport in peripheral direction of the drum a swarm of spinning fibers, at least one clamping device mounted adjacent to said drum so as to act clampingly on the spinning fibers held by suction, said clamping device forming a clamping line with an outer conical surface of said drum, at least one thread-forming device disposed downstream of or at said clamping line for receiving the spinning fibers and forming at least one thread therefrom, a suction device located in said interior of said drum and having at least one suction slit directed outwardly from said interior to said outer conical surface of said drum, said perforated drum having a conical casing, and said suction slit of said suction device extending along a spatial spiral line, a fiber feeding location being at an inner end of said spiral line, and a clamping location for the spinning fiber being at an outer end of said spiral line.

12. Device for forming spinning fibers for producing a thread, comprising a perforated drum having an interior to which suction air is applied, said drum being rotatably mounted so as to tangentially hold by suction and transport in peripheral direction of the drum a swarm of spinning fibers, at least one clamping device mounted adjacent to said drum so as to act clampingly on the spinning fibers held by suction, said clamping device forming a clamping line with an outer cylindrical surface of said drum, at least one thread-forming device disposed downstream of or at said clamping line for receiving the spinning fibers and forming at least one thread therefrom, a suction device located in said interior of said drum and having at least one suction slit directed outwardly from said interior to said outer cylindrical surface of said drum, said suction device having at least two suction slits disposed beneath said fiber feed location of said perforated drum closely adjacent to one another and mutually diverge therefrom.

13. Device for forming spinning fibers for producing a thread, comprising a perforated drum having an interior to which suction air is applied, said drum being rotatably mounted so as to tangentially hold by suction and transport in peripheral direction of the drum a swarm of spinning fibers, at least one clamping device mounted adjacent to said drum so as to act clampingly on the spinning fibers held by suction, said clamping device forming a clamping line with an outer cylindrical surface of said drum, at least one thread-forming device disposed downstream of or at said clamping line for receiving the spinning fibers and forming at least one thread therefrom, a suction device located in said interior of said drum and having at least one suction slit directed outwardly from said interior to said outer cylindrical surface of said drum, said suction device having at least two suction slits disposed beneath said fiber feed location of said perforated drum united with one another and mutually diverge therefrom.

* * * * *